US011464302B1

(12) United States Patent
Butler

(10) Patent No.: US 11,464,302 B1
(45) Date of Patent: Oct. 11, 2022

(54) INTERCHANGEABLE PIECE OR SET OF JEWELRY

(71) Applicant: Wonderment, Inc., Great Neck Plaza, NY (US)

(72) Inventor: Jerome D. Butler, Great Neck Plaza, NY (US)

(73) Assignee: WONDERMENT, INC., Great Neck Plaza, NY (US)

( * ) Notice: Subject to any disclaimer, the term of this patent is extended or adjusted under 35 U.S.C. 154(b) by 0 days.

(21) Appl. No.: 17/719,085

(22) Filed: Apr. 12, 2022

(51) Int. Cl.
*A44C 17/00* (2006.01)
*A44C 17/02* (2006.01)
*A44C 9/00* (2006.01)

(52) U.S. Cl.
CPC ..... *A44C 9/0053* (2013.01)

(58) Field of Classification Search
CPC ..... A44C 9/00; A44C 9/0053; A44C 17/0208; A44C 17/0225; A44C 17/0216
See application file for complete search history.

(56) References Cited

U.S. PATENT DOCUMENTS

2004/0016261 A1* 1/2004 Rose ..... A44C 17/0208 63/29.1
2006/0288734 A1* 12/2006 Savransky ..... A44C 9/00 63/15
2007/0056321 A1* 3/2007 Sowle ..... A44C 17/0216 63/40

FOREIGN PATENT DOCUMENTS

DE 29723196 U1 * 5/1998 ..... A44C 17/0216
DE 19809011 A1 * 9/1999 ..... A44C 17/0216
FR 655999 A * 4/1924
FR 2667486 A1 * 4/1992 ..... A44C 17/0216
FR 2849356 A1 * 7/2004 ..... A44C 17/0216
KR 950006709 Y1 * 8/1995
KR 200480186 Y1 * 4/2016

* cited by examiner

*Primary Examiner* — Jack W Lavinder
(74) *Attorney, Agent, or Firm* — Kilyk & Bowersox, P.L.L.C.

(57) ABSTRACT

An interchangeable piece of jewelry including a base and a head mount. The base includes an inner wall that defines a receptacle. The head mount includes a setting and an insert, the setting configured to retain a jewel therein and the insert being dimensioned to sit within the receptacle of the base. When the insert rests within the receptacle, an outer wall of the insert at a distal end contacts the inner wall of the receptacle such that the head mount is releasably secured within the receptacle, and the outer wall of the insert that is adjacent a proximal end and within the receptacle is spaced apart from the inner wall.

20 Claims, 8 Drawing Sheets

INTERCHANGEABLE PIECE OR SET OF JEWELRY

FIELD OF THE INVENTION

The present invention relates to jewelry. The present invention also relates to pairing and mounting jewelry.

BACKGROUND OF THE INVENTION

The manufacture of fine jewelry and costume jewelry involves the placement and connection of various parts. Jewelry commonly includes a base worn by the user and a head mount. A diamond or other stone is mounted to the head mount. Jewelry is generally offered to the customer as a finished piece. For example, engagement rings are sold as a shank (base) and head mount already fused together.

At jewelry stores or outlets, customers typically try on a piece of jewelry prior to purchase. Currently, customers are unable to view different combinations of heads and bases prior to purchasing the jewelry because the heads and bases are already fused together.

Accordingly, there is a need for a quick connect and disconnect of heads and bases of jewelry, to view different combinations prior to purchase.

SUMMARY OF THE INVENTION

A feature of the present invention is to provide jewelry that has interchangeable head mounts and bases.

A further feature of the present invention is to provide a base that is interchangeable with different head mounts.

A further feature of the present invention is to provide a head mount that is interchangeable with different bases.

A further feature of the present invention is to provide a plurality of head mounts and a plurality of bases that can be releasably attached to one another.

A further feature of the present invention is to provide a plurality of head mounts and a plurality of bases that can be releasably attached to one another, and upon selection of a pair of a head mount and a base, to fixedly secure the pair together.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention, in part, relates to an interchangeable piece of jewelry. The interchangeable piece of jewelry includes a base having an outer surface and an inner wall. The inner wall defines a receptacle having an opening at the outer surface of the base. The receptacle has a bottom. The inner wall tapers inwardly towards the bottom, such that a distance between opposing sides of the receptacle at the opening is greater than a distance between opposing sides of the receptacle at the bottom.

The interchangeable piece of jewelry further includes a head mount having a setting and an insert. The setting is configured to retain a jewel therein and the insert is dimensioned to sit within the receptacle of the base. The insert includes an outer wall, a proximal end coupled to the setting, and a distal end.

When the insert is placed within the receptacle, the outer wall of the insert at or near the distal end contacts the inner wall of the receptacle such that the head mount is releasably secured within the receptacle, and the outer wall of the insert that is adjacent the proximal end and within the receptacle is spaced apart from the inner wall.

The outer wall of the insert can taper from the proximal end to the distal end, such that a distance between opposite sides at the proximal end is greater than a distance between opposite sides at the distal end. The outer wall of the insert can further have a rounded cross-sectional shape and the inner wall that defines the receptacle can also have a rounded cross-sectional shape. The rounded cross-sectional shape of the outer wall and the rounded cross-sectional shape of the inner wall can be oval shaped or circle shaped.

The insert can further include a central shaft, a first side arm, and a second side arm, the central shaft disposed in between the first side arm and the second side arm. The receptacle can further include a central slot, a first side slot, and a second side slot, the central slot defined in between the first side slot and the second side slot, wherein the central shaft, the first arm, and the second arm fit within the central slot, the first side slot and the second side slot, respectively, when the head mount is placed within the receptacle.

Each of the first side arm and the second side arm can taper with the insert, and each of the first side slot and the second side slot can taper with the inner wall. In certain embodiments, only the outer wall, at the first side arm and the second side arm, makes contact with the inner wall at the first slot and the second slot, when the head mount is placed within the receptacle.

The present invention can further include a plate fixed to the proximal end of the insert, and the setting is secured to an upper surface of the plate. The plate includes an outer edge extending laterally beyond the outer wall of the insert.

The present invention can include a slot defined through the plate and the insert, an opening into the slot is at the upper surface of the plate, and the setting comprises a pin that fits within the slot through the opening, releasably securing the setting to the upper surface of the plate.

The piece of jewelry can further include an opening at the bottom of the receptacle, allowing a user to urge the head mount out of the receptacle from the bottom.

The piece of jewelry can include a ring, a bracelet, earrings, a necklace, a pendant, a brooch, or any type of jewelry in which a jewel, such as a stone or other decoration is mounted thereto.

The present invention further relates to a method for securing a head mount to a base of a piece of jewelry. The method includes at least the step of placing an insert of the head mount through an opening at an outer surface of the base and into a receptacle defined by an inner wall of the base, thereby releasably securing the head mount to the base. The inner wall tapers inwardly towards a bottom of the receptacle, such that a distance between opposing sides of the receptacle at the opening is greater than a distance between opposing sides of the receptacle at the bottom. The head mount includes a setting and the insert. The setting is configured to retain a jewel therein, and the insert includes an outer wall, a proximal end coupled to the setting, and a distal end. The outer wall of the insert at or near the distal end contacts the inner wall of the receptacle. The outer wall of the insert that is adjacent the proximal end and within the receptacle is spaced apart from the inner wall.

The outer wall of the insert can taper from the proximal end to the distal end, such that a distance between opposite sides at the proximal end is greater than a distance between opposite sides at the distal end.

The insert can further include a central shaft, a first side arm, and a second side arm, the central shaft disposed in between the first side arm and the second side arm. The receptacle can further include a central slot, a first side slot, and a second side slot, the central slot defined in between the first side slot and the second side slot. The step of placing the insert of the head mount through the opening and within the receptacle can include placing the central shaft, the first side arm, and the second side arm within the central slot, the first side slot, and the second side slot, respectively.

In certain embodiments, each of the first side arm and the side arm tapers with the insert, and each of the first side slot and the second side slot tapers with the inner wall. Only the outer wall, at the first side arm and the second side arm, can make contact with the inner wall at the first side slot and the second side slot. The central shaft does not make contact with the inner wall.

The head mount can further include a plate fixed to a proximal end of the insert, and the setting is fixed to an upper surface of the plate. The plate includes an outer edge extending laterally beyond the outer wall of the insert. The plate is spaced apart from the outer surface of the base, and the distal end of the insert is spaced apart from the bottom of the receptacle.

The method can further include the steps of: adjusting the dimensions of at least one of the receptacle and the insert such that the plate rests against the outer surface of the base, and the distal end of the insert is disposed at the bottom of the receptacle; and adjoining the insert to the base by a melting process, an adhesive bonding process, or a combination thereof.

It is to be understood that both the foregoing general description and the following detailed description are exemplary and explanatory only and are intended to provide a further explanation of the present invention, as claimed.

DETAILED DESCRIPTION OF THE INVENTION

Figure 1:
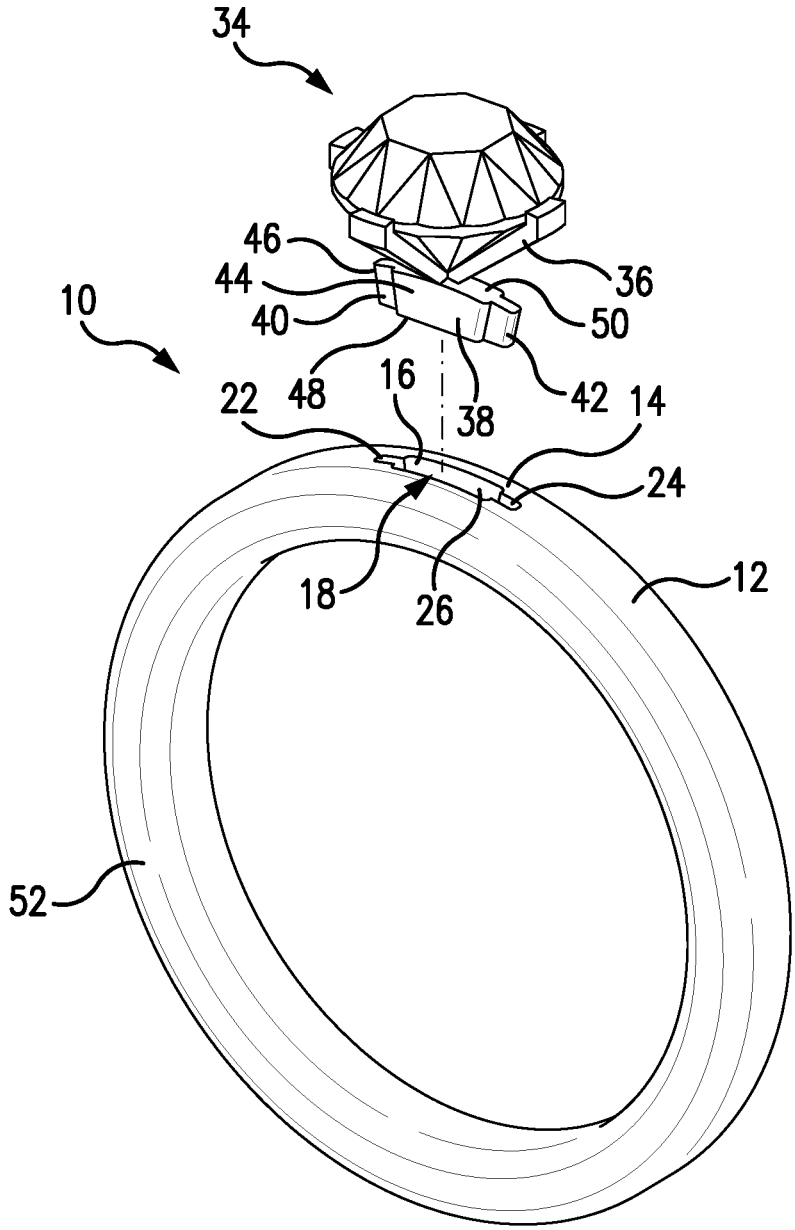
FIG. 1 a perspective exploded view of an interchangeable piece of jewelry, according to an embodiment of the present invention.

Jewelry having interchangeable head mounts and bases, and methods of mounting a head mount to a base are described herein.

According to the present invention, the interchangeably jewelry includes at least a base and a head mount. The head mount releasably secures within a receptacle of the base, allowing a customer to mix and match different bases and different head mounts together prior to selection. When the head mount of the present invention is inserted into the receptacle, tension holds the head mount in place so that the customer can try the piece of jewelry on without the head mount falling out of the receptacle.

References herein to "an example" or "a specific example" or "an aspect" or "an embodiment," or similar phrases, are intended to introduce a feature or features of the interchangeably jewelry, or components thereof, or methods of using or manufacturing the interchangeably jewelry (depending on context), and that can be combined with any combination of previously-described or subsequently-described examples, aspects, embodiments (i.e. features), unless a particular combination of features is mutually exclusive or if context indicates otherwise. Further, as used in this specification, the singular forms "a," "an," and "the" include plural referents (e.g., at least one or more) unless the context clearly dictates otherwise.

The present invention includes an interchangeable piece of jewelry. The piece of jewelry at least includes a base and a head mount that are releasably attachable together.

The interchangeable piece of jewelry of the present invention can be used at a jewelry store. A customer can try different types of bases with different types of head mounts to determine a preferred pair of a base and a head mount for permanent mounting and purchase.

The base of the interchangeable jewelry can be part of any type of jewelry that includes a jewel, such as a stone or other type of decoration. For example, the base can be part of a ring, a bracelet, a pendant, a brooch, earrings, a necklace, and the like.

The base and the head mount can be made of a precious metal such as gold, silver, platinum, or palladium as well as other metals such as titanium, copper, tungsten, rhodium, nickel, ceramic, stainless steel, cobalt, and the like. The jewel can be any type of stone, such as but not limited to, diamonds, sapphires, rubies, emeralds, tanzanite, opals, topazes, and other types of precious, semi-precious stones, or other jewels and decorations.

The base includes an outer surface and an inner wall. The inner wall defines a receptacle having an opening at the outer surface of the base. The receptacle has a bottom. The inner wall tapers inwardly towards the bottom, such that a distance between opposing sides of the receptacle at the opening is greater than a distance between opposing sides of the receptacle at the bottom.

The head mount includes a setting and an insert. The setting is configured to retain a jewel therein and the insert is dimensioned to sit within the receptacle of the base. The insert includes an outer wall, a proximal end coupled to the setting, and a distal end.

The insert of the head mount is dimensioned to fit within the receptacle such that at least a portion of the outer wall of the insert fits within the receptacle to releasably attach to the base within the receptacle.

In certain embodiments, the insert can have a conical shape, a cuboid shape, a pyramid shape, a cone shape, a keystone shape, or the like.

In certain embodiments, the outer wall of the insert includes a rounded cross-sectional shape. For example, the rounded cross-sectional shape can be an oval shape or a circle shape. The insert can taper from the proximal end to the distal end, such that a distance between opposite sides at the proximal end is greater than a distance between opposite sides at the distal end.

The receptacle of the base can be dimensioned to receive the insert. In certain embodiments, the receptacle can be dimensioned to complement the insert. The receptacle can define a conical shape, a cuboid shape, a pyramid shape, a cone shape, a keystone shape, or the like.

In certain embodiments, the inner wall that defines the receptacle can include a rounded cross-sectional shape. The rounded cross-sectional shape can be an oval shape or a circle shape. As mentioned above, the receptacle tapers inwardly towards the bottom, such that a distance between opposing sides of the receptacle at the opening is greater than a distance between opposing sides of the receptacle at the bottom.

As mentioned above, the head mount releasably secures to the base. To do so, the insert is placed within the receptacle. The taper of the inner wall of the receptacle allows for a portion of the outer wall of the insert to engage and wedge within the receptacle, thereby releasably retaining the head mount within the receptacle. At least the outer wall of the insert at or near the distal end contacts the inner wall of the receptacle. The outer wall of the insert that is adjacent the proximal end and within the receptacle is spaced apart from the inner wall.

In certain embodiments, less than 50%, less than 40%, less than 30%, less than 20%, less than 10%, less than 5%, or less than 1% of the outer wall of the insert makes contact with the inner wall of the receptacle when the insert rests within the receptacle. For example, 1% to 50% of the outer wall of the insert makes contact with the inner wall of the receptacle, 5% to 40% of the outer wall of the insert makes contact with the inner wall of the receptacle, 10% to 30% of the outer wall of the insert makes contact with the inner wall of the receptacle, 20% of the outer wall of the insert makes contact with the inner wall of the receptacle, or about 20% of the outer wall of the insert makes contact with the inner wall of the receptacle when the insert rests within the receptacle.

Due to the taper of the outer wall of the insert and the inner wall of the base, the insert is wedged into the receptacle. Thus, the customer can try on the piece of jewelry without the insert falling out of the receptacle. Due to the relatively low surface to surface contact between the outer wall of the insert and the inner wall of the base, the head mount is easily removed from the base. This allows for different bases and head mounts to releasably attach together to view the appearance of the pair of the attached base and head mount. The customer or jeweler can then easily remove the head mount from the base to select another pairing.

In certain embodiments, the insert includes a first guide and a second guide each of which extends laterally from opposing sides of the outer wall and is disposed along a vertical axis of the insert. The vertical axis of the insert is along a direction from the proximal end to the distal end.

To compliment the first guide and the second guide of the insert, the receptacle can further include a first slot and a second slot respectively defined at opposing sides of the inner wall and being disposed along a depth of the inner wall.

The first guide and the second guide fit within the first slot and the second slot, respectively, when the head mount is placed within the receptacle.

In certain embodiments, the insert can only include a first guide extending laterally from the outer wall, and the receptacle can only include a first slot defined at a side of the inner wall. The first guide of the insert fits within the first slot of the receptacle when the head mount is placed within the receptacle.

Alternatively, the insert can include three guides extending laterally from the outer wall and equidistant from one another, and the receptacle can include three slots defined at sides of the inner wall equidistant from one another. Each of the respective guides of the insert fits within each of the respective slots of the receptacle when the head mount is placed within the receptacle. The present invention can further include four guides and four respective slots, or more guides and more respective slots that complement one another.

In certain embodiments, the one or more guides of the insert can taper with the insert. The one or more slots of the receptacle can taper with the inner wall. The outer wall at the one or more guides can be the only portion of the outer wall of the insert that makes contact with the inner wall at the one or more slots of the receptacle when the insert rests within the receptacle.

For example, the first and second guide of the insert tapers with the insert and the first and second slot of the receptacle tapers with the inner wall. The outer wall at the first and second guide of the insert is the only portion that makes contact with the inner wall at the first and second slot, when the head mount rests within the receptacle. In such embodiments, the inner wall and the outer wall at all other portions of the insert and the receptacle respectively, do not engage one another.

In certain embodiments, the insert includes a central shaft, a first side arm, and a second side arm. The central shaft is disposed in between the first side arm and the second side arm. Each of the central shaft, the first side arm, and the second side arm are disposed along a vertical axis of the insert. The vertical axis of the insert is along a direction from the proximal end to the distal end.

To compliment the central shaft, the first side arm, and the second side arm of the insert, the receptacle can further include a central slot, a first side slot, and a second side slot. The first side slot and the second side slot are respectively defined at opposing sides of the inner wall and disposed along a depth of the inner wall. The central slot is defined in between the first side slot and the second side slot The central shaft, the first side arm, and the second side arm fit within the central slot, the first side slot and the second side slot, respectively, when the head mount is placed within the receptacle.

In certain embodiments, the insert can only include a first side arm and a second side arm, and the receptacle can only include a first side slot and a second side slot. The first side arm and the second side arm of the insert fits within the first side slot and the second side slot, respectively, when the head mount is placed within the receptacle.

Alternatively, the insert can include a central shaft and three sides arms, only three side arms, a central shaft and four side arms, only four side arms, and the like. The side arms can be equidistant from one another, and the receptacle can include slots accommodating each of the arms and/or shaft. Each of the respective arms and shaft of the insert fits within each of the respective slots of the receptacle when the head mount is placed within the receptacle.

In certain embodiments, the first side arm and the second side arm of the insert can taper with the insert. The first side slot and the second side slot of the receptacle can taper with the inner wall. The outer wall at first side arm and the second side arm can be the only portion of the outer wall of the insert that makes contact with the inner wall at first side slot and second side slot of the receptacle when the insert rests within the receptacle. Thus, the outer wall at the central shaft does not contact the central slot when the insert rests within the receptacle.

A radius of curvature can decrease at a bottom of the first side slot and the second side slot. Likewise, a radius of curvature can decrease at a bottom of the first side arm and the second side arm. The bottom of the first side arm and the second side arm are urged into the increased curvature at the bottom of the first side slot and the second side slot, respectively. The contact of the bottom of the first and second side arms with the bottom of the first and second side slots creates a tension that holds the insert in place while a customer considers the head and base combination. The head can easily be removed by pulling out the head from the receptacle or using a small and narrow tool that is inserted through a bottom hole of the base to poke the insert out of the receptacle from the bottom.

In certain embodiments, a first gap is defined in between the first side arm and the central shaft, and a second gap is defined in between the second side arm and the central shaft. Furthermore, the central shaft has a greater length than the first side arm and the second side arm. The first side arm and the second side arm can have an oval cross-sectional shape that increases strength of the side arms.

The insert can include an upper surface at the proximal end. The setting is fixed to the upper surface. Alternatively, a plate can be secured to the proximal end of the insert and the setting is fixed to the plate. When the head mount is placed within the receptacle, the upper surface and/or the plate of the insert is elevated above the outer surface of the base. The distal end of the insert can be spaced apart from the bottom of the receptacle when the head mount is placed within the receptacle.

To remove the head mount from the base, the head mount can be pulled out of the receptacle by the setting. In certain embodiments, the bottom of the receptacle includes a bottom opening. In such embodiments, the head mount can be removed from the base by pushing a small and narrow device through the bottom opening and urging the insert out of the receptacle from the bottom of the receptacle.

In use, a customer can enter a store and ask to try different head mounts with different bases. For example, if a customer is intending to purchase an engagement ring, the customer can pick a first head mount and a first base, and releasably attached the first head mount to the first base to view the appearance of the first base and first head mount. Due to the insert being wedged within the receptacle, the customer can try the ring on without the first head mount falling out of the first base. The customer can than remove the first head mount from the first base, and releasably secure a second head mount to the first base, releasably secure the first head mount to a second base, releasably secure the second head mount to the second base, or try other combinations. The customer can mix and match as many head mounts with as many bases as the jewelry store provides.

Once a customer decides to purchase a specifically paired head mount and base, the jeweler can adjust the paired head mount and base and fix the head mount to the base to sell to the customer. If a plate is part of the insert, the plate can be welded to the base. The edges of the plate extend over the edge of the receptacle to conceal a seam that occurs when the insert and the base are welded together. Adjustments can be made to either the receptacle, the insert, or both. For example, the guides or side arms can be ground down, the inner wall of the receptacle can be ground down, or both, such that the insert fits flush within the receptacle.

In alternative embodiments, the present invention can be provided as a set of trial bands and trial head mounts. In such embodiments, the trial bands and trial head mounts are not bonded together. Instead, the jeweler provides the matched head mount and base if available at the store, the jeweler can custom build the head mount and base, or the jeweler can order the matched head mount and base from a third party. All of the trial bands and the trial head mounts can then be used by other customers.

The present invention further includes a method for securing a head mount to a base of a piece of jewelry. The method includes placing an insert of the head mount through an opening at an outer surface of the base and into a receptacle defined by an inner wall of the base, thereby releasably securing the head mount to the base. The inner wall tapers inwardly towards a bottom of the receptacle, such that a distance between opposing sides of the receptacle at the opening is greater than a distance between opposing sides of the receptacle at the bottom. The head mount includes a setting and the insert. The setting is configured to retain a jewel therein, and the insert comprises an outer wall, a proximal end coupled to the setting, and a distal end. The outer wall of the insert at the distal end contacts the inner wall of the receptacle, and the outer wall of the insert that is adjacent the proximal end and within the receptacle is spaced apart from the inner wall.

When the insert includes one or more guides, and the receptacle includes one or more slots, the step of placing the insert of the head mount through the opening and within the receptacle includes placing the one or more guides within respective one or more slots. For example, the first guide and the second guide can be placed within the first slot and the second slot, respectively.

Each of the first guide and the second guide can taper with the insert, and each of the first slot and the second slot can taper with the inner wall. Only the outer wall, at the first guide and the second guide, can make contact with the inner wall at the first slot and the second slot.

When the insert includes a central shaft, a first side arm, and a second side arm, and the receptacle includes a central slot, a first side slot, and a second side slot, the step of placing the insert of the head mount through the opening and within the receptacle comprises: placing the central shaft, the first side arm, and the second side arm within the central slot, the first side slot, and the second side slot, respectively.

The insert can include an upper surface or plate at the proximal end. The setting is fixed to the upper surface or plate. The upper surface or plate is elevated above the outer surface of the base, and the distal end of the insert is spaced apart from the bottom of the receptacle when the insert rests within the receptacle.

When a customer decides on a matched pair of head mount and base, the method can further include the step of adjusting the dimensions of the receptacle and/or insert such that the upper surface of the insert is flush with the outer surface of the base, the plate is abutting against the outer surface of the base, and/or the distal end of the insert is disposed at the bottom of the receptacle. The method can further include fixedly adjoining the insert to the base by a melting process, such as soldering and the like. The insert can also be fixedly adjoined to the base by other bonding processes, such as an adhesive bonding process.

Referring now to the figures, FIG. 1 shows an exploded perspective view of an interchangeable piece of jewelry 10. Interchangeable piece of jewelry 10 includes a head mount 34 and a base 12.

Base 12, as shown in FIG. 1, is part of a ring 52. However, as mentioned above, base 12 can be part of other types of jewelry. Base 12 has an outer surface 14 that intersects with an inner wall 16 at a rim of a receptacle 18. The rim defines an opening 26 to receptacle 18. Opening 26 and receptacle 18 are dimensioned to receive an insert 38 of the head mount 34. The rim and inner wall 16 further define a first slot 22 and a second slot 24.

Head mount 34 includes a setting 36 that is fixedly mounted to insert 38 at a proximal end 46. Insert 38 includes an outer wall 44 that is dimensioned to fit within receptacle 18. Insert 38 further includes first guide 40 and second guide 42. Insert 38 fits within receptacle 18 by first placing a distal end 48 of insert 38 into opening 26 and into receptacle 18 until outer wall 44 of insert 38 engages inner wall 16 of base 12.

Figure 2:
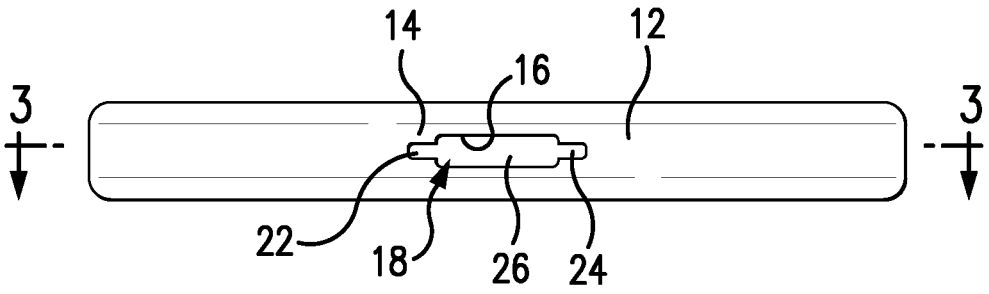
FIG. 2 is a top view of a base of the interchangeable piece of jewelry, according to an embodiment of the present invention.
Figure 3:
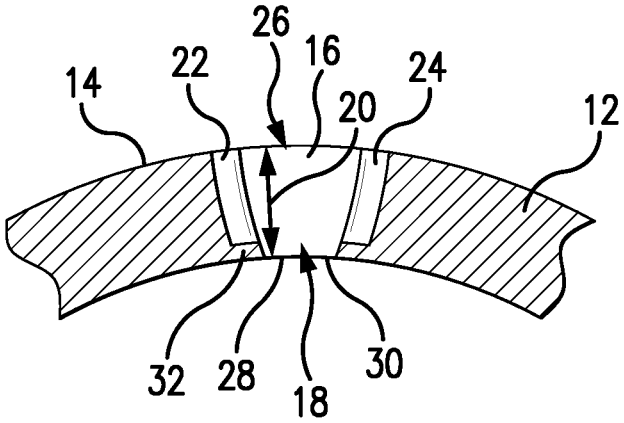
FIG. 3 is a cross-sectional side view of the interchangeable piece of jewelry shown in FIG. 2 taken along line 3-3, depicting the inner wall of the base.

FIG. 2 shows a top view of base 12 and FIG. 3 shows a cross sectional view of FIG. 2 taken along line 3-3 of FIG. 2. FIGS. 2 and 3 illustrate outer surface 14, inner wall 16, receptacle 18, first slot 22, and second slot 24. FIG. 3 further illustrates a depth 20 of receptacle 18 and a bottom 28 that includes a bottom opening 30 and a bottom surface 32.

As can be seen, inner wall 16 tapers inwardly towards a bottom 28 of receptacle 18, such that a distance between opposing sides of receptacle 18 at opening 26 is greater than a distance between opposing sides of the receptacle at bottom 28.

First slot 22 and second slot 24 are respectively defined at opposing sides of inner wall 16 and are disposed along depth 20 of the inner wall 16. Each of first slot 22 and second slot 24 tapers with inner wall 16. Thus, each of first slot 22 and second slot 24 tapers inwardly towards bottom 28 of receptacle 18, such that a distance between first slot 22 and second slot 24 at opening 26 is greater than a distance between first slot 22 and second slot 24 of the receptacle at or near bottom 28.

As illustrated in FIGS. 2 and 3, inner wall 16 defines a keystone shape with first slot 22 and second slot 24 extending laterally from opposing sides.

Figure 4:
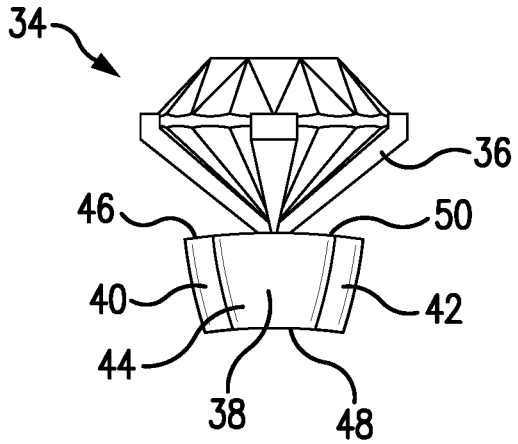
FIG. 4 is a side view of a head mount, according to an embodiment of the present invention.

FIG. 4 shows a side view of head mount 34 of an embodiment of the present invention. Head mount 34 includes setting 36 that is fixedly mounted to insert 38 at proximal end 46. Setting 36 retains a jewel, such as a stone, to head mount 34. Insert 38 includes outer wall 44 that is dimensioned to fit within the receptacle of the base. Outer wall 44 of insert 38 tapers from proximal end 46 to distal end 48, such that a distance between opposite sides at proximal end 46 is greater than a distance between opposite sides at distal end 48.

Insert 38 further includes first guide 40 and second guide 42 each of which extends laterally from opposing sides of outer wall 44 and is disposed along a vertical axis of insert 38, the vertical axis being along a direction from proximal end 46 to distal end 48. First guide 40 and second guide 42 fit within the first slot and the second slot of the receptacle, respectively, when head mount 34 is placed within the receptacle of the base. Each of first guide 40 and second guide 42 tapers with insert 38, such that a distance between first guide 40 and second guide 42 at proximal end 46 is greater than a distance between first guide 40 and second guide 42 at distal end 48.

As illustrated in FIG. 4, insert 38 is a keystone shape with first guide 40 and second guide 42 extending laterally from opposing sides. Receptacle 18 of FIGS. 2 and 3 is similar in shape to insert 38 of FIG. 4.

Figure 5:
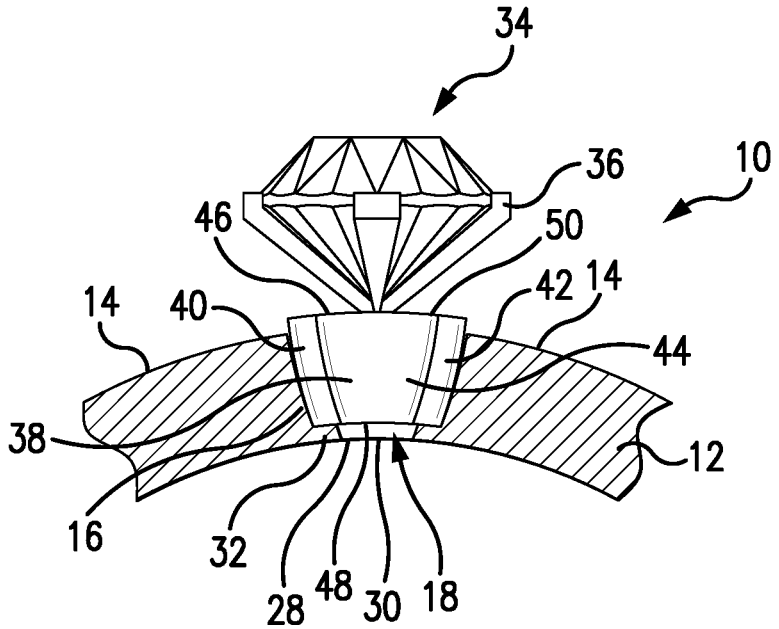
FIG. 5 is a cross-sectional side view of an interchangeable piece of jewelry showing an insert of a head mount disposed within a receptacle of a base, according to an embodiment of the present invention.

FIG. 5 shows interchangeable piece of jewelry 10 with head mount 34 releasably secured within receptacle 18 of base 12. Head mount 34 includes setting 36 that is fixedly mounted to insert 38 at proximal end 46. Setting 36 retains a jewel, such as a stone, to head mount 34. Insert 38 includes outer wall 44 that tapers from proximal end 46 to distal end 48. Insert 38 further includes an upper surface 50 at proximal end 46. Setting 36 is fixed to upper surface 50.

Base 12 includes outer surface 14 that intersects with inner wall 16 at the rim. Inner wall 16 defines receptacle 18. As shown in FIG. 5, when insert 38 is placed within receptacle 18, outer wall 44 of insert 38 at distal end 48 contacts inner wall 16 of receptacle 18 such that head mount 34 is releasably secured within receptacle 18, and outer wall 44 of insert 38 that is adjacent proximal end 46 and within receptacle 18 is spaced apart from inner wall 16. Further, upper surface 50 is elevated above outer surface 14 of base 12 and distal end 48 of insert 38 is spaced apart from bottom 28 of receptacle 18. Distal end 48 of insert 38 can rest on bottom surface 32. To remove head mount 34 from receptacle 18 of base 12, a user can use an elongated and narrow device that fits through bottom opening 30 and urge insert 38 out of receptacle 18 from distal end 48. Due to the low surface area contact between outer wall 44 of insert 38 and inner wall 16 of base 12, head mount 34 is easily removed from base 12.

Figure 6:
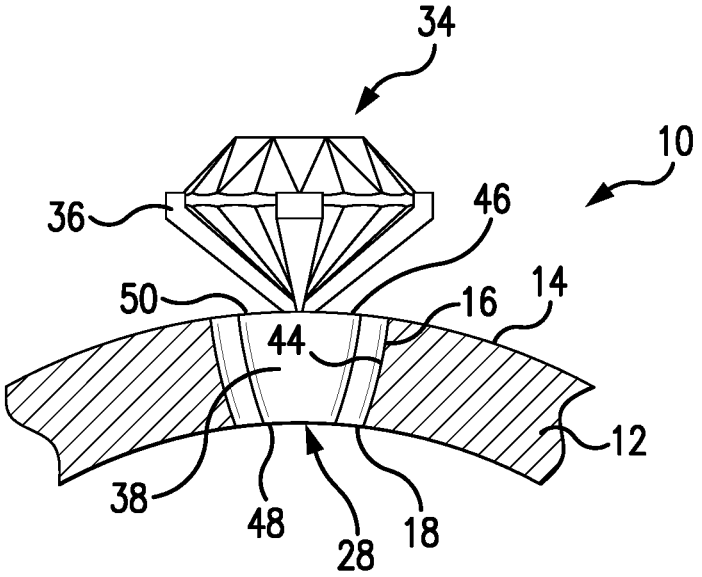
FIG. 6 is a cross-sectional side view of the interchangeable piece of jewelry showing an insert of a head mount disposed within a receptacle of a base with the insert fixedly secured to the base, according to an embodiment of the present invention.

FIG. 6 shows interchangeable piece of jewelry 10 with head mount 34 fixedly mounted within receptacle 18 of base 12. Head mount 34 includes setting 36 that is fixedly mounted to insert 38 at proximal end 46. Setting 36 retains a jewel, such as a stone, to head mount 34. Insert 38 includes outer wall 44 that tapers from proximal end 46 to distal end 48. Insert 38 further includes upper surface 50 at proximal end 46. Setting 36 is fixed to upper surface 50.

Base 12 includes outer surface 14 that intersects with inner wall 16 at the rim. Inner wall 16 defines receptacle 18. As shown in FIG. 6, dimensions of receptacle 18 are adjusted such that insert 38 completely fits within receptacle 18. Bottom surface 32 is also removed. As can be seen, upper surface 50 of insert 38 is now flush with outer surface 14 of base 12. Distal end 48 of insert 38 is now disposed at bottom 28 of receptacle 18 and is flush with a bottom surface of base 12.

Dimensions of receptacle 18 can be adjusted by mechanical or chemical means, such as filing, grinding, chipping, melting, chemically treating, or a combination thereof.

After the dimensions of receptacle 18 are adjusted and head mount 34 is secured within receptacle 18, as shown in FIG. 6, insert 38 can be fixedly adjoined to base 12 by a melting process, a bonding process, or the like.

Figure 7:
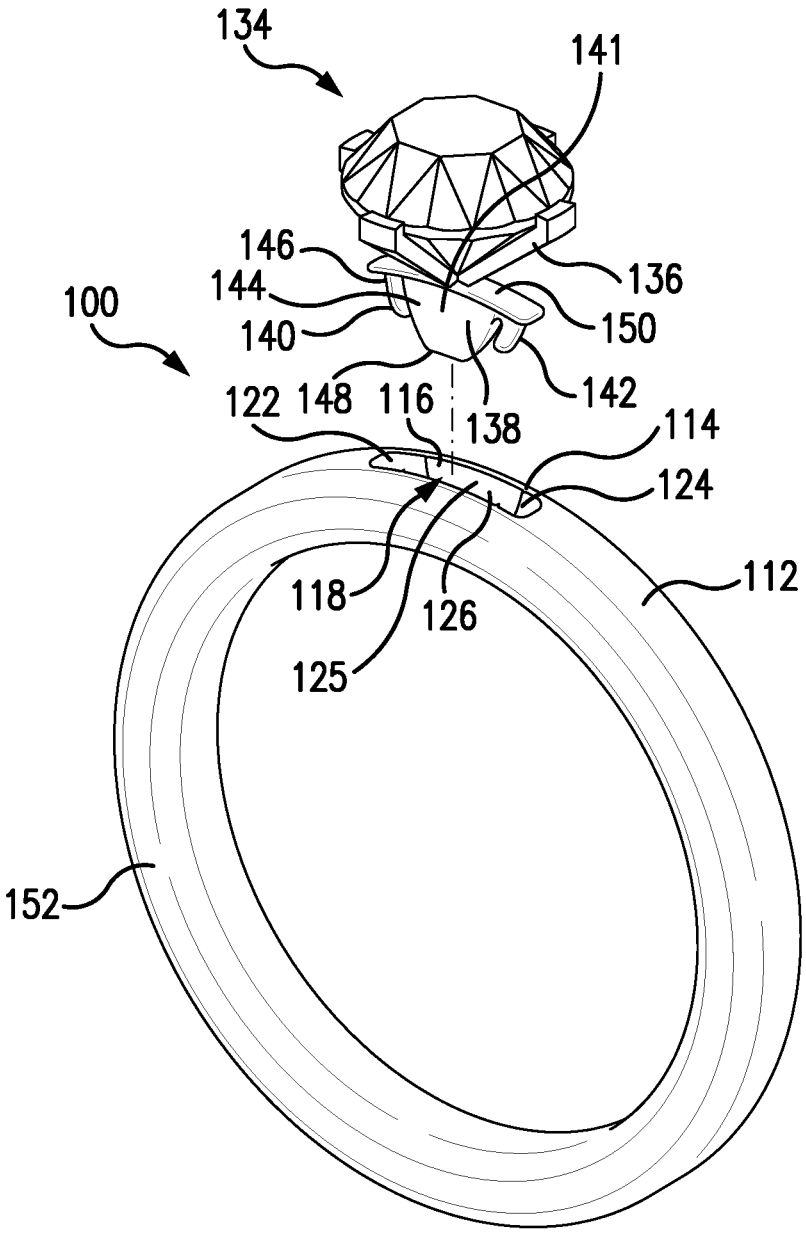
FIG. 7 a perspective exploded view of an interchangeable piece of jewelry, according to an embodiment of the present invention.

FIG. 7 shows an exploded perspective view of an interchangeable piece of jewelry 100. Interchangeable piece of jewelry 100 includes a head mount 134 and a base 112.

Base 112, as shown in FIG. 7, is part of a ring 152. However, as mentioned above, base 112 can be part of other types of jewelry. Base 112 has an outer surface 114 that intersects with an inner wall 116 at a rim of a receptacle 118. Rim defines an opening 126 to receptacle 118. Opening 126 and receptacle 118 are dimensioned to receive an insert 138 of head mount 134. Rim and inner wall 116 further define a first side slot 122, a second side slot 124, and central slot 125.

Head mount 134 includes a setting 136 that is fixedly mounted to insert 138 at a proximal end 146 by a plate 150. Insert 138 includes an outer wall 144 that is dimensioned to fit within receptacle 118. Insert 138 further includes a central shaft 141, a first side arm 140, and a second side arm 142. Insert 138 fits within receptacle 118 by first placing a distal end 148 of insert 138 into opening 126 and into receptacle 118 until outer wall 144 of insert 138 engages inner wall 116 of base 112.

Figure 8:
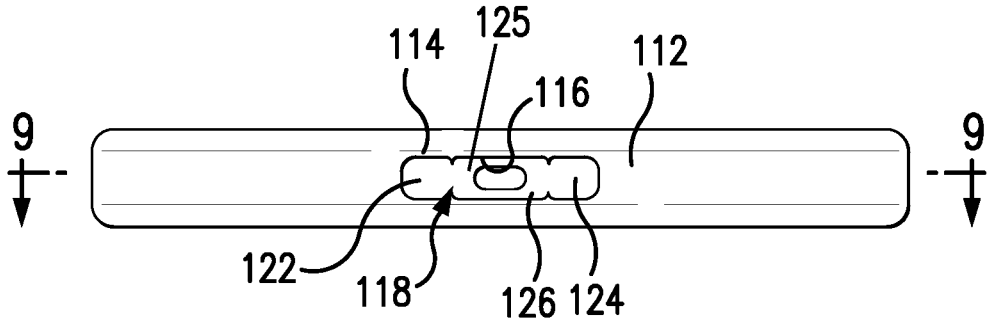
FIG. 8 is a top view of a base of the interchangeable piece of jewelry, according to an embodiment of the present invention.
Figure 9:
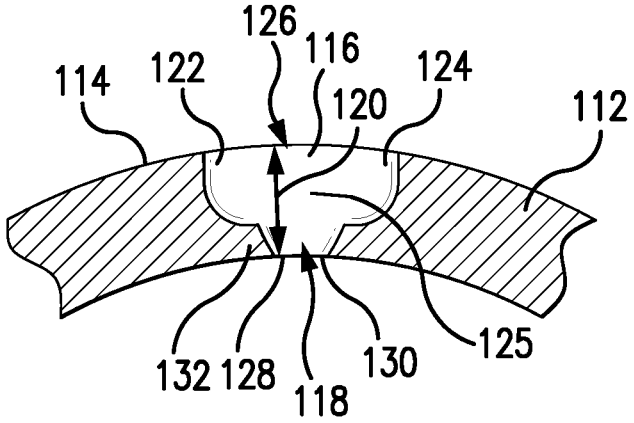
FIG. 9 is a cross-sectional side view of the interchangeable piece of jewelry shown in FIG. 8 taken along line 9-9, depicting the inner wall of the base.

FIG. 8 shows a top view of base 112 and FIG. 9 shows a cross sectional view of FIG. 8 taken along line 9-9 of FIG. 8. FIGS. 8 and 9 illustrate outer surface 114, inner wall 116, receptacle 118, first side slot 122, second side slot 124, and central slot 125. FIG. 9 further illustrates a depth 120 of receptacle 118 and a bottom 128 that includes a bottom opening 130 and a bottom surface 132.

As can be seen, inner wall 116 tapers inwardly towards bottom 128 of receptacle 118, such that a distance between opposing sides of receptacle 118 at opening 126 is greater than a distance between opposing sides of the receptacle at bottom 128.

First side slot 122 and second side slot 124 are respectively defined at opposing sides of inner wall 116 and are disposed along depth 120 of the inner wall 116. Central slot 125 is defined in between first side slot 122 and second side slot 124. Each of first side slot 122 and second side slot 124 tapers with inner wall 116. Thus, each of first side slot 122 and second side slot 124 tapers inwardly towards bottom 128 of receptacle 118, such that a distance between first side slot 122 and second side slot 124 at opening 126 is greater than a distance between first side slot 122 and second side slot 124 of the receptacle near bottom 128.

Figure 10:
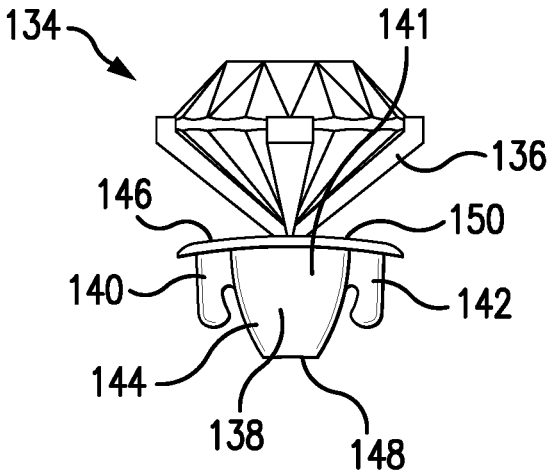
FIG. 10 is a side view of a head mount, according to an embodiment of the present invention.

FIG. 10 shows a side view of head mount 134 of an embodiment of the present invention. Head mount 134 includes setting 136 that is fixedly mounted to insert 138 at proximal end 146. Setting 136 retains a jewel, such as a stone, to head mount 134. Insert 138 includes outer wall 144 that is dimensioned to fit within the receptacle of the base. Outer wall 144 of insert 138 can taper from proximal end 146 to distal end 148, such that a distance between opposite sides at proximal end 146 is greater than a distance between opposite sides at distal end 148.

Insert 138 further includes central shaft 141, first side arm 140, and second side arm 142. Central shaft 141 is disposed in between first side arm 140 and second side arm 142. Central shaft 141, first side arm 140, and second side arm 142 are disposed along a vertical axis of insert 138, the vertical axis being along a direction from proximal end 146 to distal end 148. Central shaft 141, first side arm 140, and second side arm 142 fit within the central slot, the first side slot and the second side slot, respectively, when head mount 134 is placed within the receptacle of the base. Each of first side arm 140 and second side arm 142 can taper with insert 138, such that a distance between first side arm 140 and second side arm 142 at proximal end 146 is greater than a distance between first side arm 140 and second side arm 142 at distal ends.

As illustrated in FIG. 10, a first gap is defined in between first side arm 140 and central shaft 141, and a second gap is defined in between second side arm 142 and central shaft 141. Receptacle 118 of FIGS. 8 and 9 define a similar shape to insert 138 of FIG. 10.

First side arm 140, central shaft 141, and second side arm 142 can be made of a malleable material, such as gold or other precious metal. Thus, when insert 138 is placed within many receptacles, first side arm 140 and second side arm 142 can deform from their original shape. To adjust first side arm 140 and second side arm 142 back to their original shape, a blade can be inserted in between first side arm 140 and central shaft 141, as well as in between second side arm 142 and central shaft 141, to pry first and second side arms 140, 142 away from central shaft 141 and back to their original position.

Figure 11:
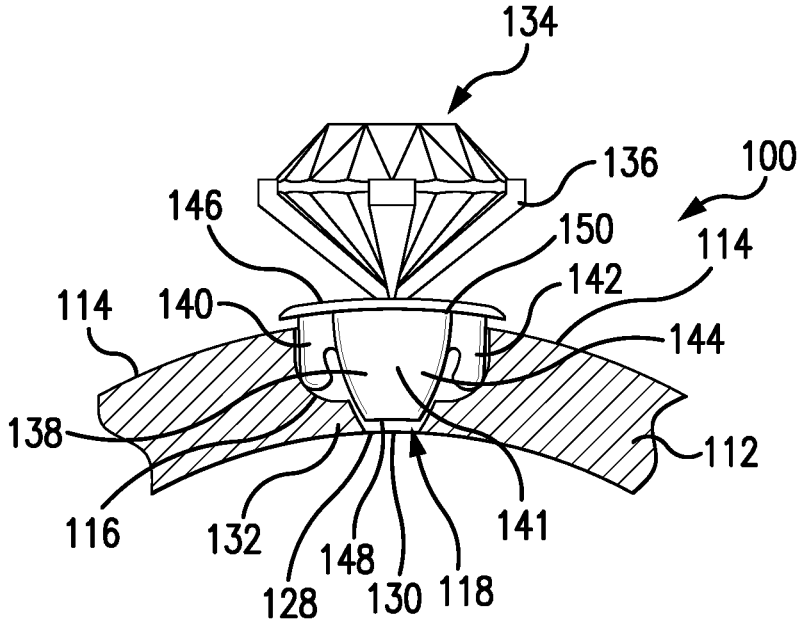
FIG. 11 is a cross-sectional side view of an interchangeable piece of jewelry showing an insert of a head mount disposed within a receptacle of a base, according to an embodiment of the present invention.

FIG. 11 shows interchangeable piece of jewelry 100 with head mount 134 releasably secured within receptacle 118 of base 112. Head mount 134 includes setting 136 that is fixedly mounted to insert 138 at plate 150. Setting 136 retains a jewel, such as a stone, to head mount 134. Insert 138 includes outer wall 144 that tapers from proximal end 146 to distal end 148. Setting 136 is fixed to plate 150. Insert 138 further includes central shaft 141, first side arm 140, and second side arm 142.

Base 112 includes outer surface 114 that intersects with inner wall 116 at the rim. Inner wall 116 defines receptacle 118. As shown in FIG. 11, when insert 138 is placed within receptacle 118, outer wall 144 of insert 138 contacts inner wall 116 of receptacle 118 such that head mount 134 is releasably secured within receptacle 118, and outer wall 144 of insert 138 that is adjacent proximal end 146 and within receptacle 118 is spaced apart from inner wall 116. In particular, only outer wall 144, at first side arm 140 and second side arm 142, makes contact with inner wall 116 at the first side slot and the second side slot, when head mount 134 rests within 118 receptacle. Only distal ends of first side arm 140 and second side arm 142 can engage outer wall 144, while a remainder of insert 138 is not in contact with outer wall. Further, plate 150 is elevated above outer surface 114 of base 112 and distal end 148 of insert 138 is spaced apart from bottom 128 of receptacle 118. To remove head mount 134 from receptacle 118 of base 112, a user can use an elongated and narrow device that fits through bottom opening 130 of bottom 132 and urge insert 138 out of receptacle 118 from distal end 148. Due to the low surface area contact between outer wall 144 of insert 138 and inner wall 116 of base 112, head mount 134 is easily removed from base 112.

Figure 12:
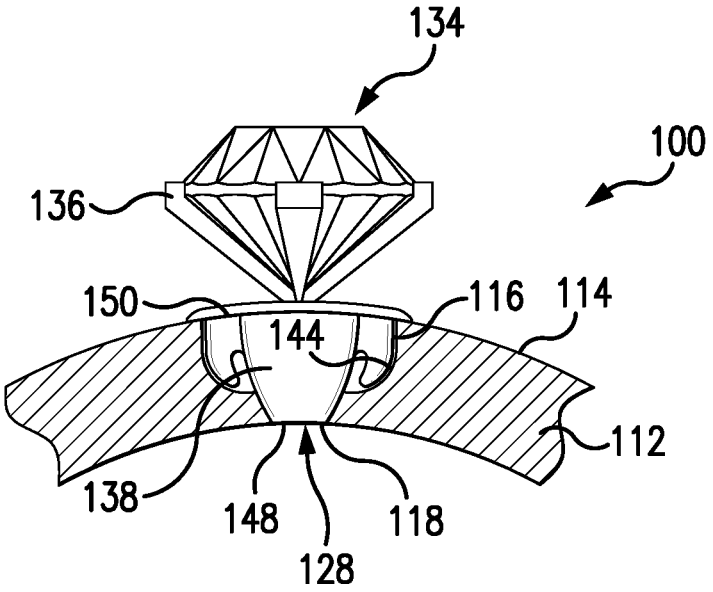
FIG. 12 is a cross-sectional side view of the interchangeable piece of jewelry showing an insert of a head mount disposed within a receptacle of a base with the insert fixedly secured to the base, according to an embodiment of the present invention.

FIG. 12 shows interchangeable piece of jewelry 100 with head mount 134 fixedly mounted within receptacle 118 of base 112. Head mount 134 includes setting 136 that is fixedly mounted to insert 138 at plate 150. Setting 136 retains a jewel, such as a stone, to head mount 134. Insert 138 includes outer wall 144 that tapers from proximal end 146 to distal end 148.

Base 112 includes outer surface 114 that intersects with inner wall 116 at the rim. Inner wall 116 defines receptacle 118. As shown in FIG. 12, dimensions of insert 138 are adjusted such that insert 138 completely fits within receptacle 118. As can be seen, plate 150 is now resting against outer surface 114 of base 112. Distal end 148 of insert 138 is now disposed at bottom 128 of receptacle 118 and is flush with a bottom surface of base 112.

Dimensions of receptacle 118 and/or insert 138 can be adjusted by mechanical or chemical means, such as filing, grinding, chipping, melting, chemically treating, or a combination thereof.

After the dimensions of receptacle 118 and/or insert 138 are adjusted and head mount 134 is secured within receptacle 118, as shown in FIG. 12, insert 138 can be fixedly adjoined to base 112 by a melting process, a bonding process, or the like.

Figure 13:
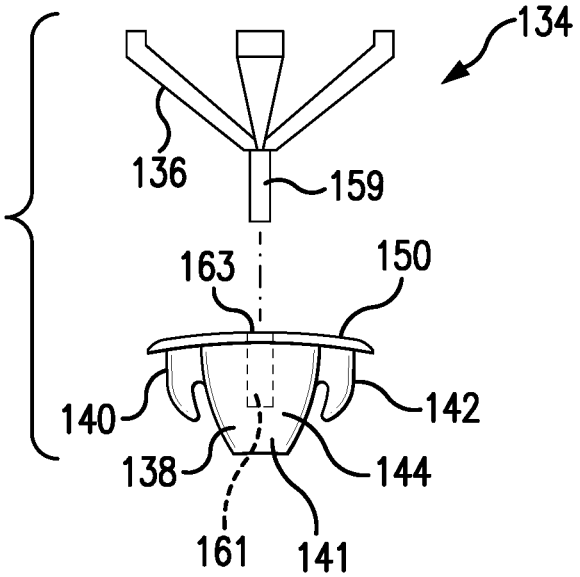
FIG. 13 an exploded view of a head mount, according to an embodiment of the present invention.

FIG. 13 shows an exploded view of head mount 134 of an embodiment of the present invention. Head mount 134 includes setting 136 and insert 138. Setting 136 retains a jewel, such as a stone, to head mount 134. Insert 138 includes outer wall 144 that is dimensioned to fit within the receptacle of the base. Insert 138 further includes plate 150, central shaft 141, first side arm 140, and second side arm 142. A slot 161 is defined through plate 150 and insert 138. An opening 163 into slot 161 is at the upper surface of plate 150. Setting 136 further includes a pin 159 that fits within slot 161 through the opening 163, releasably securing setting 136 to the upper surface of plate 150. This configuration allows for a user to secure different settings 136 to different inserts 138, allowing for additional interchangeability of the piece of jewelry.

The disclosure herein refers to certain illustrated examples, it is to be understood that these examples are presented by way of example and not by way of limitation. The term "about," as it appears herein, is intended to indicate that the values indicated can vary by plus or minus 5%. The intent of the foregoing detailed description, although discussing exemplary examples, is to be construed to cover all modifications, alternatives, and equivalents of the examples as can fall within the spirit and scope of the invention as defined by the additional disclosure.

The entire contents of all cited references in this disclosure, to the extent that they are not inconsistent with the present disclosure, are incorporated herein by reference.

The present invention can include any combination of the various features or embodiments described above and/or in the claims below as set forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. An interchangeable piece of jewelry comprising:

a base comprising an outer surface and an inner wall, the inner wall defining a receptacle having an opening at the outer surface of the base, the receptacle having a bottom, wherein the inner wall tapers inwardly towards the bottom, such that a distance between opposing sides of the receptacle at the opening is greater than a distance between opposing sides of the receptacle at the bottom; and a head mount comprising a setting and an insert, the setting configured to retain a jewel therein and the insert being dimensioned to sit within the receptacle of the base, the insert comprising an outer wall, a proximal end coupled to the setting, and a distal end, wherein when the insert rests within the receptacle, a first portion of the outer wall of the insert contacts the inner wall of the receptacle such that the head mount is releasably secured within the receptacle, and a second portion of the outer wall of the insert that is adjacent the proximal end and within the receptacle is spaced apart from the inner wall.

2. The interchangeable piece of jewelry of claim 1, wherein the base is part of a ring.

3. The interchangeable piece of jewelry of claim 1, wherein the outer wall of the insert tapers from the proximal end to the distal end, such that a distance between opposite sides at the proximal end is greater than a distance between opposite sides at the distal end.

4. The interchangeable piece of jewelry of claim 3, wherein the outer wall of the insert comprises a rounded cross-sectional shape and the inner wall that defines the receptacle comprises a rounded cross-sectional shape.

5. The interchangeable piece of jewelry of claim 1, wherein the insert further comprises a central shaft, a first side arm, and a second side arm, the central shaft disposed in between the first side arm and the second side arm, the receptacle further comprising a central slot, a first side slot and a second side slot, the central slot defined in between the first side slot and the second side slot, wherein the central shaft, the first arm, and the second arm fit within the central slot, the first side slot and the second side slot, respectively, when the head mount rests within the receptacle.

6. The interchangeable piece of jewelry of claim 5, wherein each of the first side slot and the second side slot tapers.

7. The interchangeable piece of jewelry of claim 6, wherein only the outer wall, at distal ends of the first side arm and second side arm, makes contact with the inner wall at the first side slot and the second side slot, when the head mount rests within the receptacle.

8. The interchangeable piece of jewelry of claim 5, wherein a first gap is defined in between the first side arm and the central shaft, and a second gap is defined in between the second side arm and the central shaft.

9. The interchangeable piece of jewelry of claim 5, wherein the central shaft has a greater length than the first side arm and the second side arm.

10. The interchangeable piece of jewelry of claim 1, further comprising a plate fixed to the proximal end of the insert, and the setting is secured to an upper surface of the plate, the plate comprising an outer edge extending laterally beyond the outer wall of the insert.

11. The interchangeable piece of jewelry of claim 10, wherein a slot is defined through the plate and the insert, an opening into the slot is at the upper surface of the plate, and the setting comprises a pin that fits within the slot through the opening, releasably securing the setting to the upper surface of the plate.

12. The interchangeable piece of jewelry of claim 1, wherein the distal end of the insert is spaced apart from the bottom of the receptacle when the head mount rests within the receptacle.

13. The interchangeable piece of jewelry of claim 1, wherein the bottom of the receptacle comprises a bottom opening.

14. A method for securing a head mount to a base of a piece of jewelry comprising:

placing an insert of the head mount through an opening at an outer surface of the base and into a receptacle defined by an inner wall of the base, thereby releasably securing the head mount to the base, wherein the inner wall tapers inwardly towards a bottom of the receptacle, such that a distance between opposing sides of the receptacle at the opening is greater than a distance between opposing sides of the receptacle at the bottom, the head mount comprises a setting and the insert, the setting is configured to retain a jewel therein, and the insert comprises an outer wall, a proximal end coupled to the setting, and a distal end, a first portion of the outer wall of the insert contacts the inner wall of the receptacle, and a second portion of the outer wall of the insert that is adjacent the proximal end and within the receptacle is spaced apart from the inner wall.

15. The method of claim 14, wherein the outer wall of the insert tapers from the proximal end to the distal end, such that a distance between opposite sides at the proximal end is greater than a distance between opposite sides at the distal end.

16. The method of claim 14, wherein the insert further comprises a central shaft, a first side arm, and a second side arm, the central shaft disposed in between the first side arm and the second side arm, the receptacle further comprises a central slot, a first side slot, and a second side slot, the central slot defined in between the first side slot and the second side slot.

17. The method of claim 16, wherein the step of placing the insert of the head mount through the opening and within the receptacle comprises: placing the central shaft, the first side arm, and the second side arm within the central slot, the first side slot, and the second side slot, respectively.

18. The method of claim 16, wherein each of the first side slot and the second side slot tapers, and only the outer wall, at distal ends of the first side arm and the second side arm, makes contact with the inner wall at the first side slot and the second side slot.

19. The method of claim 15, wherein the head mount further comprises a plate fixed to a proximal end of the insert, and the setting is fixed to an upper surface of the plate, the plate comprising an outer edge extending laterally beyond the outer wall of the insert, wherein the plate is spaced apart from the outer surface of the base, and the distal end of the insert is spaced apart from the bottom of the receptacle.

20. The method of claim 19, further comprising:

adjusting the dimensions of at least one of the receptacle and the insert such that the plate rests against the outer surface of the base, and the distal end of the insert is disposed at the bottom of the receptacle; and adjoining the insert to the base by a melting process, an adhesive bonding process, or a combination thereof.

* * * * *